US007467663B2

(12) United States Patent
Reimert

(10) Patent No.: US 7,467,663 B2
(45) Date of Patent: Dec. 23, 2008

(54) HIGH PRESSURE WELLHEAD ASSEMBLY INTERFACE

(75) Inventor: Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 332 days.

(21) Appl. No.: 11/220,111

(22) Filed: Sep. 6, 2005

(65) Prior Publication Data

US 2006/0048945 A1 Mar. 9, 2006

Related U.S. Application Data

(60) Provisional application No. 60/607,666, filed on Sep. 7, 2004.

(51) Int. Cl.
*E21B 29/12* (2006.01)

(52) U.S. Cl. ..... 166/344; 166/348; 166/88.1; 285/123.12; 277/322

(58) Field of Classification Search ..... 166/368, 166/348, 344, 88.1; 277/322–344, 603, 626; 285/123.12, 80, 133.21, 917
See application file for complete search history.

(56) References Cited

U.S. PATENT DOCUMENTS 3,321,217 A * 5/1967 Ahlstone ..... 285/18
3,688,841 A * 9/1972 Benton ..... 166/89.2
4,109,942 A * 8/1978 Morrill ..... 285/123.13
4,278,278 A * 7/1981 Chambless et al. ..... 285/123.12
4,353,560 A * 10/1982 Tohill ..... 277/328
4,384,730 A * 5/1983 Diehl ..... 277/322
4,496,172 A 1/1985 Walker ..... 285/18
4,569,540 A * 2/1986 Beson ..... 285/93
4,583,746 A * 4/1986 Lawson ..... 277/314
4,593,914 A * 6/1986 Johnson ..... 277/322
4,690,221 A * 9/1987 Ritter, Jr. ..... 166/382
4,693,497 A * 9/1987 Pettus et al. ..... 285/12
4,757,860 A 7/1988 Reimert ..... 166/208
4,832,381 A * 5/1989 Boulton ..... 277/621
4,902,044 A * 2/1990 Williams et al. ..... 285/18
5,039,140 A * 8/1991 Szymczak ..... 285/334.2
5,076,356 A 12/1991 Reimert ..... 166/115
5,103,915 A * 4/1992 Sweeney et al. ..... 166/379
5,129,660 A * 7/1992 Taylor et al. ..... 277/328
5,309,991 A 5/1994 Watkins
6,293,345 B1 * 9/2001 Watkins ..... 166/368
6,474,417 B1 * 11/2002 Blair et al. ..... 166/368

(Continued)

FOREIGN PATENT DOCUMENTS

EP 109541 A1 * 5/1984

(Continued)

*Primary Examiner*—Thomas A Beach
(74) *Attorney, Agent, or Firm*—Paul R. Morico; Baker Botts L.L.P.

(57) ABSTRACT

A wellhead assembly with high pressure interface is provided. The wellhead assembly includes a tubing spool that connects the wellhead to a BOP and a casing hanger that is landed in the wellhead and connected thereto. The wellhead assembly further includes a gasket that is disposed between opposing ends of the tubing spool and casing hanger. A connector engages the wellhead and tubing spool forcing the opposing ends of the tubing spool and casing hanger together, which thereby applies a compressive load to the gasket, which in turn forms a fluid tight seal therebetween.

19 Claims, 3 Drawing Sheets

U.S. PATENT DOCUMENTS 6,598,680 B2 7/2003 DeBerry
6,609,734 B1 * 8/2003 Baugh ..... 285/322
6,729,392 B2 5/2004 DeBerry et al.
6,824,171 B2 11/2004 Milberger et al. ..... 285/123.13
7,025,360 B2 4/2006 Walker et al.
7,117,945 B2 * 10/2006 Hopper et al. ..... 166/348
2003/0136556 A1 * 7/2003 Cornelssen et al. ..... 166/65.1
2005/0269102 A1 12/2005 McCanna et al.
2006/0017287 A1 1/2006 Milberger

FOREIGN PATENT DOCUMENTS

GB 2408989 A * 6/2005

* cited by examiner

HIGH PRESSURE WELLHEAD ASSEMBLY INTERFACE

CROSS REFERENCE TO RELATED APPLICATION

This application claims the benefit of U.S. Provisional Application No. 60/607,666 filed on Sep. 7, 2004.

BACKGROUND

The present invention relates generally to a subsea wellhead assembly interface, and more particularly to a high pressure seal that is formed between the tubing spool and a casing hanger connected to the wellhead.

In conventional subsea wellhead assemblies, a tubing spool connects the wellhead to the blowout preventor stack ("BOP"). As used herein, the terms "connect," "connects," and "connected," are intended to mean either indirect or direction connection. Thus, if a first device "connects" to a second device, that connection may be through a direct connection or through an indirect connection via other devices or connectors. A gasket is in turn seated between the wellhead and the tubing spool to prevent the loss of pressure out of the system. The gaskets used in such systems are typically formed of solid metal rings and are designed to seal at 15,000 psi (15 ksi). For production pressures of 20 ksi, higher rated gaskets need to be used. Furthermore, an 18¾ inch (15 ksi) BOP is required to be used during drilling with wellhead assemblies that will experience production pressures of 20 ksi during production.

It has been desired to construct wellhead assemblies that can withstand 20 ksi production pressures without the need for BOPs as large as 18¾ inches. It is more commercially viable to develop a 13⅝ inch (20 ksi) BOP than a 18¾ inch (20 ksi) BOP. The present invention achieves the desired balance between being able to form a pressure seal that can withstand production pressures of 20 ksi and which can do so within a wellhead assembly that employs a 18¾ inch BOP during 15 ksi drilling and a 13⅝ inch BOP during 20 ksi production.

SUMMARY

In one embodiment, the present invention is directed to a wellhead assembly. The wellhead assembly includes a casing hanger landed in and connected to a wellhead and a tubing spool disposed above and adjacent to the casing hanger. The wellhead assembly further includes means for sealing an end of the tubing spool to an opposing end of the casing hanger. In one embodiment, the sealing means includes a gasket disposed between the opposing ends of the tubing spool and casing hanger. In one embodiment, the gasket is formed of a tapered solid metal ring formed with a rib, which can be sized to accommodate variances in the tolerances of the wellhead, casing hanger and tubing spool.

In one embodiment, the wellhead assembly further includes an isolation sleeve coaxially disposed within the casing hanger and tubing spool. The wellhead assembly may further include a pair of isolation sleeve seal assemblies. One of the pair of isolation sleeve assemblies is disposed between the isolation sleeve and the casing hanger and the other of the pair of isolation sleeve seal assemblies is disposed between the isolation sleeve and the tubing spool.

In one embodiment, the wellhead assembly further includes a connector that connects the tubing spool to the casing hanger and applies a preload to the tubing spool and casing hanger. Also, in one embodiment, the wellhead assembly further includes a seal assembly disposed between an outer surface of the casing hanger and an inner surface of the wellhead.

BRIEF DESCRIPTION OF THE DRAWINGS

A more complete understanding of the present disclosure and advantages thereof may be acquired by referring to the following description taken in conjunction with the accompanying drawings wherein.

The drawings are intended merely to depict representative embodiments and are not intended to be limiting of the present invention the scope of which is defined by the accompanying claims.

DETAILED DESCRIPTION

Figure 1:
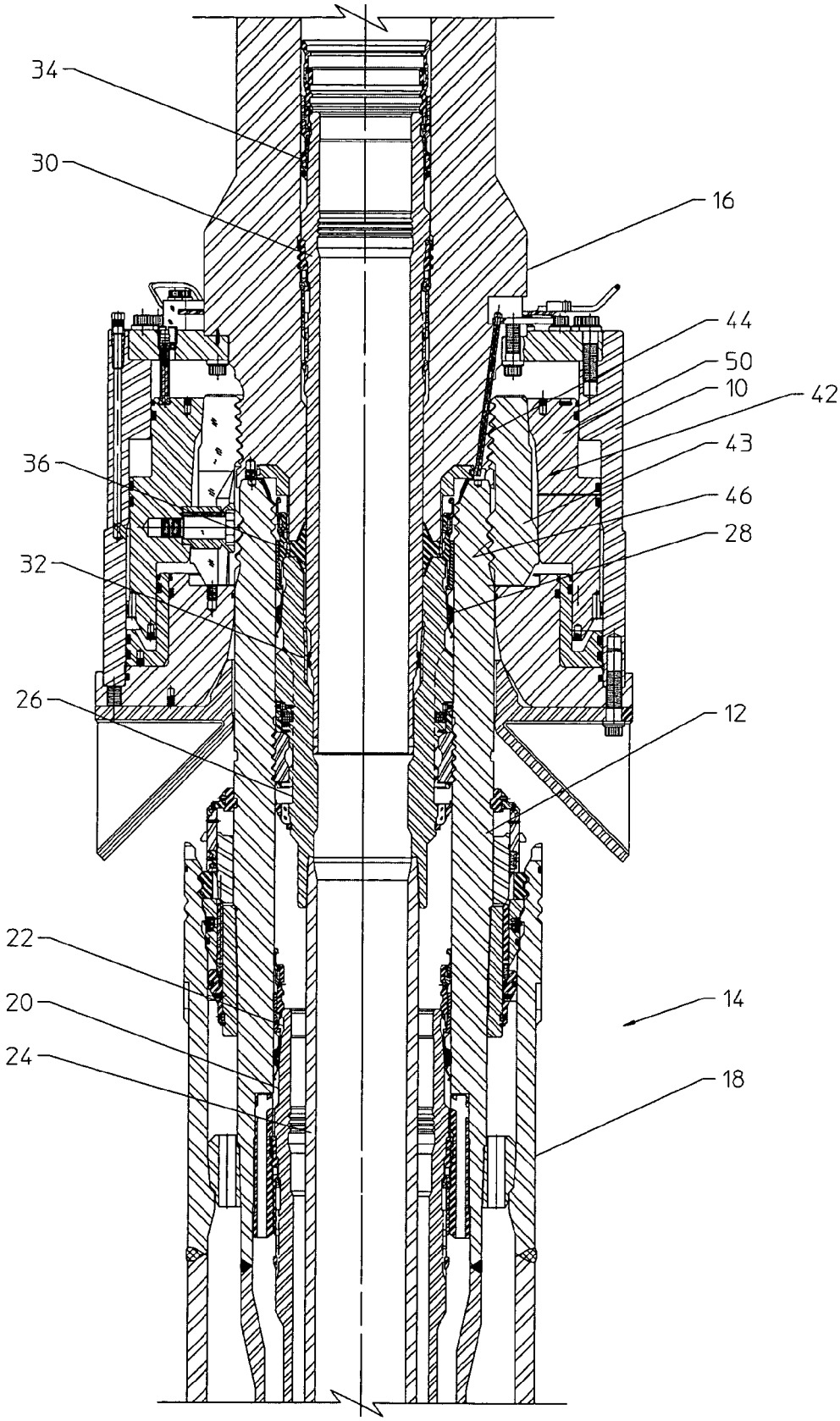
FIG. 1 is schematic diagram of a subsea wellhead assembly illustrating the high pressure interface in accordance with the present invention.

The details of the present invention will now be described with reference to the accompanying drawings. Turning to FIG. 1, a wellhead assembly in accordance with the present invention is shown generally by reference numeral 10. The wellhead assembly 10 includes a wellhead 12, which in one certain embodiment is a 18¾ inch wellhead housing. The wellhead assembly 10 connects a plurality of nested casing pipes 14 to a tubing spool 16, which in one embodiment, has an inside diameter smaller than 18¾ inches and is formed of a 20 ksi tubing.

Figure 2:
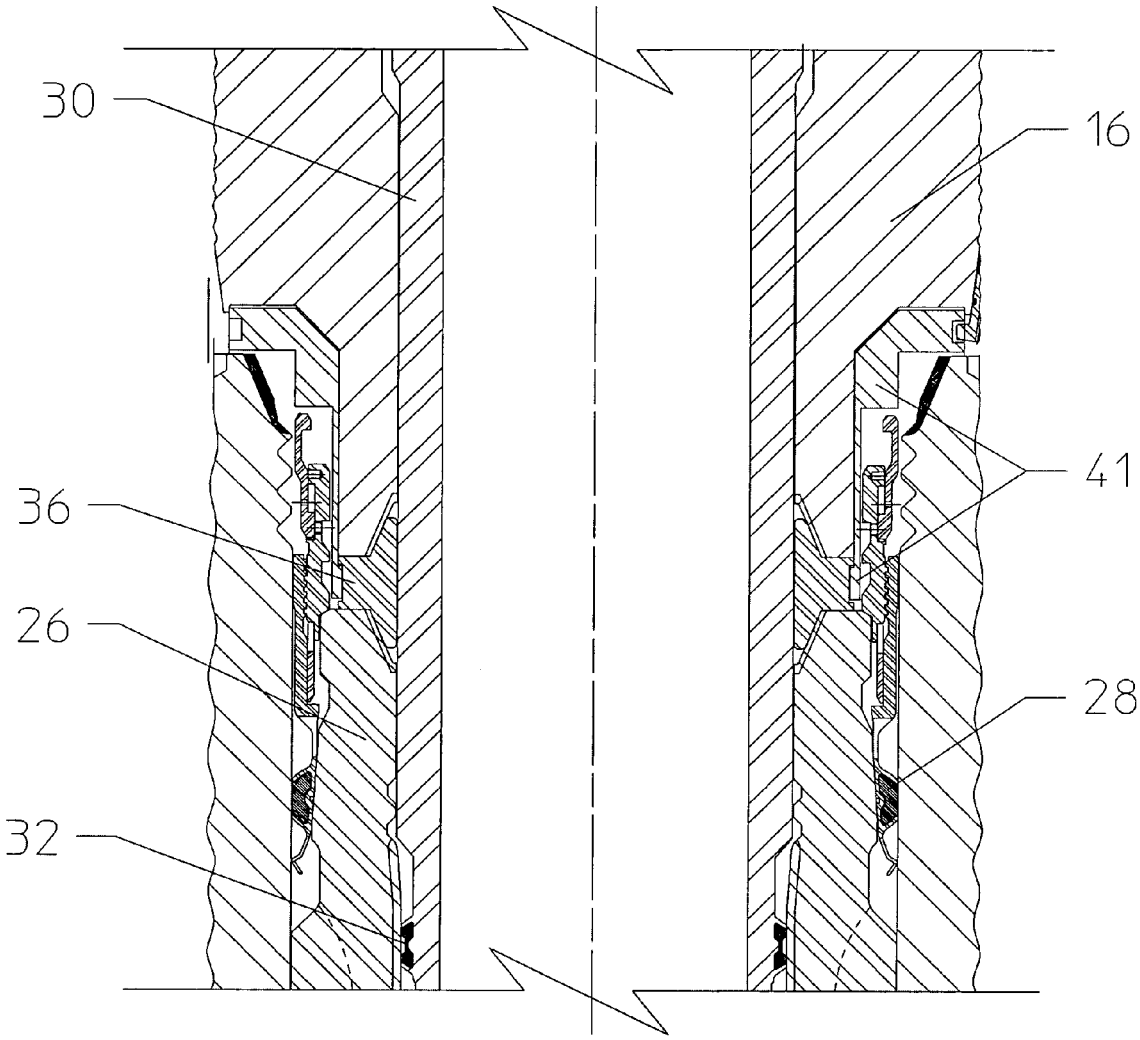
FIG. 2 is an enlarged view of the high pressure wellhead assembly interface in accordance with the present invention.

The plurality of nested casing pipes 14 include a conductor pipe 18, which is connected via a plurality of seals to an outside surface of the wellhead 12. The plurality of nested casing pipes 14 also include a surface casing pipe (not shown), which hangs from a casing hanger 20 that is connected via a seal assembly 22 to an inside surface of the wellhead 12. The plurality of nested casing pipes 14 further include a production casing 24, which in turn hangs from a casing hanger 26, which is connected to the inside surface of the wellhead 12, as best shown in FIG. 2. A seal assembly 28 is disposed between the inside surface of the wellhead 12 and the outside surface of the casing hanger 26 and forms a fluid-tight seal between the two components. In one certain exemplary embodiment, the seal assembly 28 herein may be of the type shown and described in U.S. Pat. No. 4,757,860, more specifically seal assembly 40 disclosed therein. The disclosure of said patent is hereby incorporated by reference.

The tubing spool 16 in turn connects the 18¾ inch wellhead assembly 10 to a BOP stack (not shown), which in one certain embodiment is a 13⅝ inch diameter BOP stack. The tubing spool or spool 16 in one certain embodiment is formed of an 13⅝ inch inside diameter 20 ksi tubing.

An isolation sleeve 30 is disposed inside spool 16 and casing hanger 26. The isolation sleeve 30 has a pair of seal assemblies 32 and 34, which seal the lower end of the isolation sleeve to the inside surface of the casing hanger 26 and the upper end of the isolation sleeve to the inside surface of the spool 16, respectively. In one certain embodiment, the lower seal assembly 32 is formed of a metal-to-metal seal with resilient backup and the upper seal 34 is formed of a metal-to-metal seal. The seal assemblies 32 and 34 thus may also be of the type disclosed in U.S. Pat. No. 4,757,860.

Figure 3:
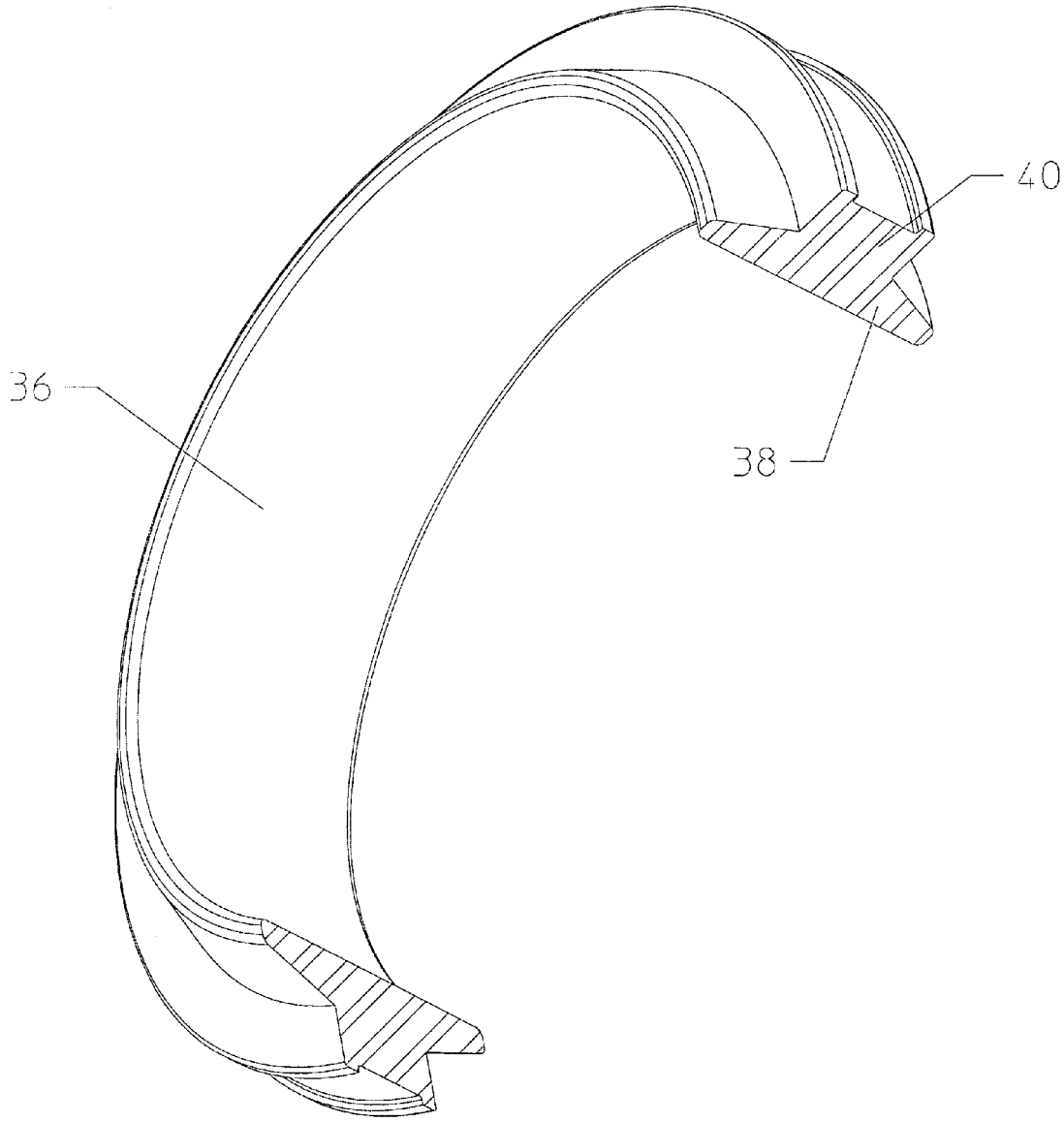
FIG. 3 is a partial cut-away view of a gasket used in the high pressure wellhead assembly interface in accordance with the present invention.

The wellhead assembly 10 in accordance with the present invention further includes a seal means, which is disposed between opposing ends of the tubing spool 16 and casing hanger 26. In one embodiment, the sealing means includes a gasket 36. Together the opposing ends of the tubing spool 16 and casing hanger 26 and gasket 36 form a wellhead assembly interface according to the present invention. This interface is best illustrated in FIG. 2. In one embodiment, the gasket 36 is formed of a solid metal ring, which in one certain embodiment may be made out of stainless steel. The gasket 36 includes a tapered base 38 and a rib 40 formed thereon, which is best seen in FIG. 3. In one certain embodiment, the gasket 36 is a DX gasket rated for 20 ksi.

The height of the gasket 36 can be varied depending upon the distance from the top of wellhead 12 to the top of the casing hanger 26. This is done as follows. Before the tubing spool 16 is run, the distance between the top of the wellhead 12 and the top of the casing hanger 26 would be measured. Then the correct height of the gasket 36 can be determined. Then a gasket 36 is made to the correct height. Alternatively, a set of pre-manufactured gaskets 36 of varying height are brought to the well site and the one with the correct height is selected and installed. The gasket 36 is installed so that the tubing spool 16 is preloaded to the casing hanger 26 when the gasket 36 is energized.

In one embodiment, the gasket 36 is attached to the tubing spool 16 using gasket retainer 41 and run in with the tubing spool 16. In an alternate embodiment, just prior to running the tubing spool 16, the gasket 36 can be placed on the casing hanger 26 using a remotely operated vehicle (ROV).

The present invention further includes a connector 42 that connects the tubing spool 16 to the casing hanger 26 and applies a preload to both components. In one exemplary embodiment, the connector 42 includes a latch ring 43, which in one certain embodiment is formed of a plurality of dog segments. The dog segments are arc-shaped members that are assembled end-to-end to form a ring. In one certain embodiment, six (6) such members are employed. In an alternate embodiment, the latch ring is formed of a C-ring.

The latch ring 43 includes a pair of upper and lower teeth 44 and 46. The upper teeth 44 of the latch ring 43 are designed to mate with and engage corresponding teeth formed on an outer surface of the tubing spool 16. The lower teeth 46 of the latch ring 43 are adapted to mate with and engage corresponding teeth formed at an upper end of the wellhead 12. An external force supplied by cam ring 50 (itself activated by pressurized fluid) forces the latch ring 43 to mate with and engage the corresponding teeth on the tubing spool 16 and wellhead 12. As the tapered surfaces of the teeth engage the wellhead 12 and tubing spool 16, the wellhead and tubing spool are forced axially closer to one another. Because the casing hanger 26 is rigidly connected to the wellhead 12, as the wellhead 12 is forced closer to the tubing spool 16, the opposing ends of the tubing spool 16 and casing hanger 26 are forced together. The gasket 36 disposed between the opposing ends of the tubing spool 16 and casing hanger 26 is thereby forced into compression, which in turn forms a fluid tight seal therebetween.

The setting of the isolation sleeve seals 32 and 34 and gasket seal 36 will now be described. First, after the wellhead 12 and casing hanger 26 have been installed but before the tubing spool 16 is run-in, the actual distance between the top of the casing hanger 26 and top of the wellhead 12 is measured. This can be done, e.g., using an ROV (not shown). Next, the height of the gasket 36 is selected based on this height. More specifically, the gasket 36 is sized so that the tubing spool 16 will land on rib 40 at approximately the same time it lands on top of the wellhead 12. In one certain embodiment, the height of the gasket 36 is also sized so that the gasket is preloaded between the tubing spool 16 and the casing hanger 26 to create a seal, which can withstand a pressure of approximately 20 ksi or greater. The gasket 36 can then be attached to the tubing spool 16 via gasket retainer 41 and run-in with the tubing spool 16, as described above. Alternatively, the tubing spool 16 can be run-in without the gasket 36 and the gasket can be installed in situ via the ROV prior to landing the tubing spool 16. Next, the gasket 36 can be set by preloading with the connector. Finally, the isolation sleeve 30 can be landed in the tubing spool 16 and casing hanger 26. The isolation sleeve seal assemblies 32 and 34 can be set using known techniques.

The combination of the upper and lower isolation sleeve assemblies 32 and 34, which serve as the primary 20 ksi seal, and the seal created by the gasket 36, which serves as the secondary 20 ksi seal, form a pressure barrier that prevents high pressure production fluid from leaking out of the wellhead assembly 10 into the subsea environment.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A subsea wellhead assembly comprising:

(a) a casing hanger landed in a wellhead;

(b) a tubing spool disposed adjacent and above the casing hanger;

(c) a metal gasket disposed between opposing ends of the tubing spool and the casing hanger, wherein the opposing ends of the tubing spool and the casing hanger are disposed in the wellhead; and (d) a seal assembly disposed between the outer surface of the casing hanger and the inner surface of the wellhead.

2. The wellhead assembly according to claim 1 further comprising means for compressing the gasket so as to place it into sealing engagement with the casing hanger and tubing spool.

3. The wellhead assembly according to claim 2 wherein the compression means comprises a connector adapted to connect the tubing spool to the wellhead and apply a preload to the tubing spool and casing hanger.

4. The wellhead assembly according to claim 1 further comprising an isolation sleeve coaxially disposed within the casing hanger and tubing spool.

5. The wellhead assembly according to claim 4 further comprising a pair of isolation sleeve seal assemblies wherein one of the pair of isolation sleeve seal assemblies is disposed between the isolation sleeve and the casing hanger and the other of the pair of isolation sleeve seal assemblies is disposed between the isolation sleeve and the tubing spool.

6. The wellhead assembly according to claim 1 wherein the tubing spool has an inside diameter smaller than 18¾ inches and is formed of a 20 ksi tubing.

7. The wellhead assembly according to claim 1 wherein the gasket comprises a tapered base and a rib formed thereon.

8. The wellhead assembly according to claim 1 wherein the height of the gasket is sized so that the gasket is preloaded between the tubing spool and the casing hanger to create a seal, which can withstand a pressure of approximately 20 ksi or greater.

9. A subsea wellhead assembly comprising:

(a) a casing hanger connected to a wellhead;

(b) a tubing spool disposed adjacent to the casing hanger;

(c) means for sealing the tubing spool to the casing hanger; the sealing means disposed between opposing ends of the tubing spool and the casing hanger, wherein the opposing ends of the tubing spool and the casing hanger are disposed in the wellhead; and (d) a seal assembly disposed between the outer surface of the casing hanger and the inner surface of the wellhead.

10. The wellhead assembly according to claim 9 wherein the sealing means comprises a ring-shaped gasket.

11. The wellhead assembly according to claim 10 further comprising means for compressing the gasket so as to place it into sealing engagement with the casing hanger and tubing spool.

12. The wellhead assembly according to claim 11 wherein the compression means comprises a connector adapted to connect the tubing spool to the wellhead and apply a preload to the tubing spool and casing hanger.

13. The wellhead assembly according to claim 9 further comprising an isolation sleeve coaxially disposed within the casing hanger and tubing spool.

14. The wellhead assembly according to claim 13 further comprising a pair of isolation sleeve seal assemblies wherein one of the pair of isolation sleeve seal assemblies is disposed between the isolation sleeve and the casing hanger and the other of the pair of isolation sleeve seal assemblies is disposed between the isolation sleeve and the tubing spool.

15. The wellhead assembly according to claim 9 wherein the tubing spool has an inside diameter smaller than 18¾ inches and is formed of a 20 ksi tubing.

16. The wellhead assembly according to claim 10 wherein the gasket comprises a tapered base and a rib formed thereon.

17. The wellhead assembly according to claim 10 wherein the height of the gasket is sized so that the gasket is preloaded between the tubing spool and the casing hanger to create a seal, which can withstand a pressure of approximately 20 ksi or greater.

18. The wellhead assembly according to claim 7, wherein the gasket comprises a gasket rated for 20 ksi.

19. The wellhead assembly according to claim 16, wherein the gasket comprises a gasket rated for 20 ksi.

* * * * *